US007045939B2

(12) United States Patent
Teramura et al.

(10) Patent No.: US 7,045,939 B2
(45) Date of Patent: May 16, 2006

(54) SPARK PLUG HAVING A WELDED ELECTRODE AND THE METHOD OF PRODUCING THE SAME

(75) Inventors: Hideki Teramura, Mie (JP); Mamoru Musasa, Nagoya (JP); Kiyohiro Kondo, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/098,380

(22) Filed: Mar. 18, 2002

(65) Prior Publication Data

US 2002/0130603 A1 Sep. 19, 2002

(30) Foreign Application Priority Data

Mar. 19, 2001 (JP) ..... 2001-078314

(51) Int. Cl.
*H01T 13/20* (2006.01)
*H01T 21/02* (2006.01)

(52) U.S. Cl. ..... 313/141; 313/144; 313/135; 445/7

(58) Field of Classification Search ..... 313/140–144, 313/135–136, 130, 137, 138, 118; 445/7
See application file for complete search history.

(56) References Cited

U.S. PATENT DOCUMENTS 4,439,707 A * 3/1984 Hattori et al. ..... 313/130
4,439,708 A * 3/1984 Hattori et al. ..... 313/140
4,514,657 A * 4/1985 Igashira et al. ..... 313/130
4,771,210 A * 9/1988 Mohle et al. ..... 313/141
5,395,273 A * 3/1995 Matsutani ..... 445/7
5,461,276 A * 10/1995 Matsutani et al. ..... 313/141
5,488,262 A * 1/1996 Takamura ..... 313/141
5,811,915 A * 9/1998 Abe et al. ..... 313/141
5,856,724 A 1/1999 Chiu et al.

(Continued)

FOREIGN PATENT DOCUMENTS

EP 0 587 446 A1 3/1994
EP 1 049 222 A1 11/2000

(Continued)

OTHER PUBLICATIONS

EPO European Search Report for EP Application No. 02 00 6004 dated May 15, 2003.

*Primary Examiner*—Joseph Williams
*Assistant Examiner*—Dalei Dong
(74) *Attorney, Agent, or Firm*—Sughrue Mion, PLLC

(57) ABSTRACT

A spark plug used in an automotive internal combustion engine. The spark plug includes a center electrode. An insulator is disposed around the center electrode. A metal main body is disposed around the insulator. A ground electrode has a first end section connected to the metal main body, and a second end section located opposite to the center electrode. Additionally, a tip is formed of an alloy whose main component is Ir. The tip is secured to the ground electrode and serving as a spark consumption-resistant electrode material. The tip has an axis directed to the center electrode. In the spark plug, a molten and solidified section formed of alloy is disposed to fix the tip to the ground electrode. The molten and solidified section includes a surrounding molten and solidified section located surrounding a peripheral surface of a major part of the tip embedded in the ground electrode.

15 Claims, 7 Drawing Sheets

U.S. PATENT DOCUMENTS

| | | | | |
|---|---|---|---|---|
| 5,877,584 | A * | 3/1999 | Kato et al. | 313/143 |
| 6,147,441 | A * | 11/2000 | Osamura | 313/141 |
| 6,232,704 | B1 * | 5/2001 | Herweg et al. | 313/141 |
| 6,523,515 | B1 * | 2/2003 | Kanao | 123/169 EL |
| 6,923,699 | B1 * | 8/2005 | Matsubara et al. | 445/7 |

FOREIGN PATENT DOCUMENTS

| | | |
|---|---|---|
| JP | 62-268079 | 11/1987 |
| JP | 62-268079 A | 11/1987 |
| JP | 2000-40577 | 2/2000 |

* cited by examiner

SPARK PLUG HAVING A WELDED ELECTRODE AND THE METHOD OF PRODUCING THE SAME

BACKGROUND OF THE INVENTION

1. Field of the Invention

This invention relates to improvements in a spark plug to be used in an internal combustion engine, and a method of producing the spark plug.

2. Description of the Prior Art

Hitherto, a variety of spark plugs for automotive internal combustion engines and the like have been proposed and put into practical use. Of these spark plugs, there is one in which a tip formed of an alloy whose main component is a noble metal is welded to an electrode so as to form an ignition section. Additionally, various attempts have been made to prevent the tip from falling off from the electrode.

In this regard, Japanese Patent Provisional Publication No. 62-268079 discloses the following technique: A ground electrode is formed with an insertion hole having such a shape that the tip cannot fall off toward a spark gap. The tip is inserted into the insertion hole in such a manner to form a depression defined by the tip and the ground electrode. The depression is filled with a lid member formed of the same alloy as that of the parent material of the ground electrode, and then resistance welding is made on the lid member and the ground electrode, thereby fixing the tip to the ground electrode.

Additionally, Japanese Patent Provisional Publication No. 2000-40577 discloses the following technique: Resistance welding is made from the side of a spark gap to fix the tip to a ground electrode, and then laser welding is made from the opposite side of the spark gap to fix the tip and the ground electrode.

However, in the former conventional technique, the tip cannot fall off toward the spark gap; however, the tip is merely pressed against the ground electrode by the lid member and therefore cannot be seemed to be firmly fixed to the ground electrode. In order to securely fix the tip to the ground electrode, a high dimensional precision is required for the lid member, the insertion hole and the tip, thereby raising machining cost. This is undesirable. Additionally, the tip and the ground electrode are not in completely tight contact with each other, and therefore thermal conduction between them is not so good. Particularly, this technique is accomplished by using the tip whose main component is Ir, heat of the tip cannot be transmitted to the side of the ground electrode, so that the temperature of the tip rises thereby particularly increasing the consumption of the tip owing to spark discharge.

In the latter conventional technique, the tip is fixed to the ground electrode only with molten (and solidified) sections formed by the resistance welding and the laser welding. In case that the tip is formed of an alloy whose main component is a noble metal (particularly, Ir), such a tip is largely different in melting point from a Ni-based alloy which is, in general, used as the patent material of the ground electrode, and therefore it is difficult to securely weld the tip and the ground electrode under the resistance welding. As a result, welding of the tip and the ground electrode substantially relies only on the laser welding, thereby rendering it difficult to completely prevent the tip from peeling off and falling off from the ground electrode.

BRIEF SUMMARY OF THE INVENTION

In view of the above, it has been desired to obtain a spark plug which exhibits a durability over 1000,000 miles in a high speed and high power output automotive engine, and a continuous use durability for several thousands hours in a cogeneration system or the like.

It is an object of the present invention to provide an improved spark plug and an improved production method for the spark plug, which effectively overcome drawbacks encountered in conventional spark plugs and conventional production methods for spark plugs.

Another object of the present invention is to provide an improved spark plug and an improved production method for the spark plug, by which the spark plug are highly durable under severe operating conditions of a high speed and high power output internal combustion engine.

A further object of the present invention is to provide an improved spark plug and an improved production method for the spark plug, by which a tip formed of an alloy whose main component is Ir cannot peel off and fall off from a ground electrode even though the spark plug is used for a long time under severe conditions.

An aspect of the present invention resides in a spark plug comprising a center electrode. An insulator is disposed around the center electrode. A metal main body is disposed around the insulator. A ground electrode has a first end section connected to the metal main body, and a second end section located opposite to the center electrode. Additionally, a tip is formed of an alloy whose main component is Ir. The tip is secured to the ground electrode and serving as a spark consumption-resistant electrode material. The tip has an axis directed to the center electrode. In the spark plug, a molten and solidified section formed of alloy is disposed to fix the tip to the ground electrode. The molten and solidified section includes a surrounding molten and solidified section located surrounding a peripheral surface of a major part of the tip embedded in the ground electrode.

Another aspect of the present invention resides in a method of producing a spark plug including a center electrode, an insulator disposed around the center electrode, and a metal main body disposed around the insulator. The method comprises the steps of: (a) preparing a ground electrode having a first end section connected to the metal main body, and a second end section located opposite to the center electrode, the ground electrode having a first surface facing the spark gap, and a second surface opposite to the first surface, the ground electrode having a portion defining an insertion hole extending from the first surface to the second surface, the insertion hole defining portion including an engaging portion; (b) preparing a tip serving as a spark consumption-resistant electrode material, the tip including a first section, and a second section smaller in cross-sectional area than the first section; (c) inserting the tip into the insertion hole in a manner that the first section of the tip is brought into engagement with the engaging portion of the ground electrode and that the tip is located below the second surface of the ground electrode to form a depression; (d) inserting a lid member in the depression; and (e) welding the lid member and the ground electrode in a manner that whole of lid member melts and that a molten material originated from at least the lid member fills a clearance formed between the tip and a surface of the insertion hole.

BRIEF DESCRIPTION OF THE DRAWINGS

In the drawings, like reference numerals designate like parts and elements throughout all figures, in which.

DETAILED DESCRIPTION OF THE INVENTION

Figure 1:
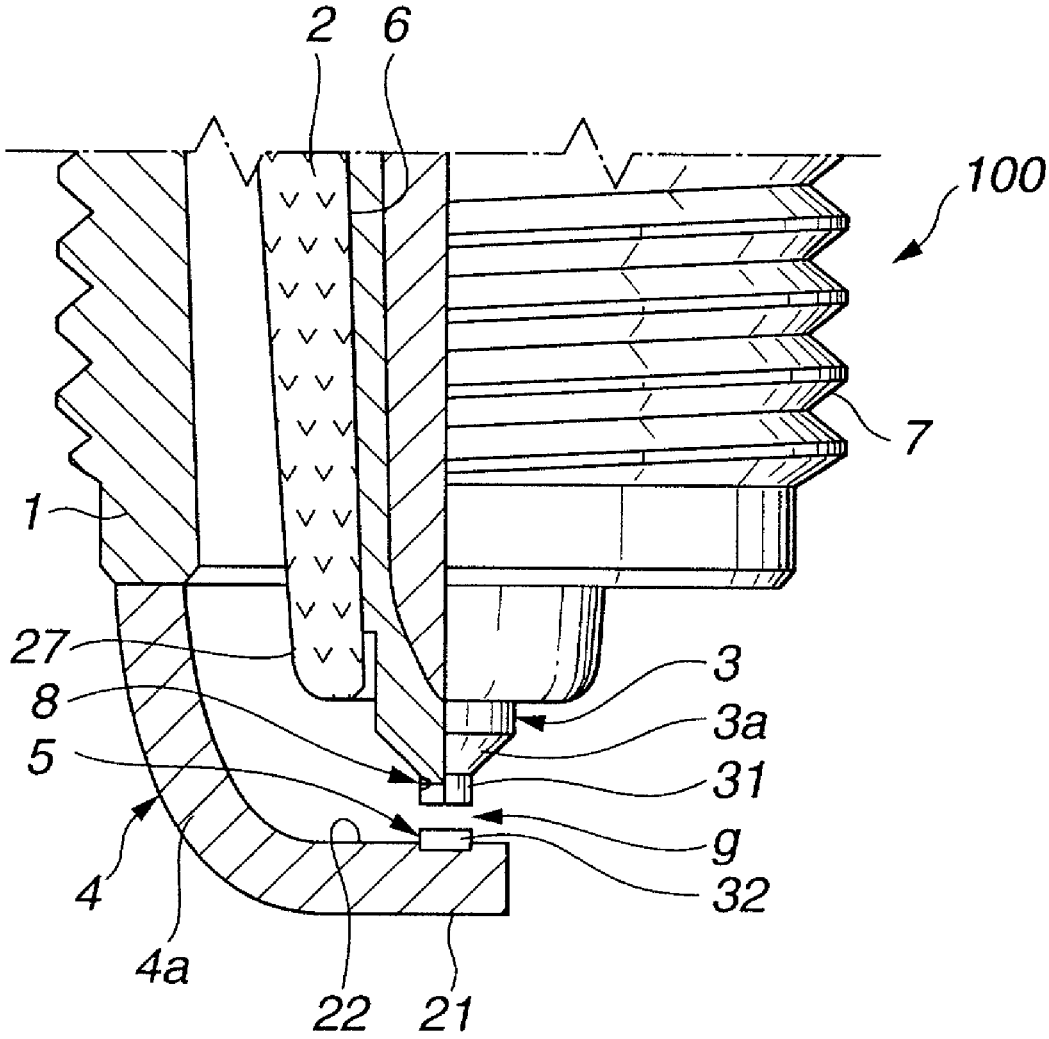
FIG. 1 is a fragmentary front elevation partly in section of an essential part of a spark plug according to the present invention.

Referring now to FIG. 1, an embodiment of a spark plug according to the present invention is illustrated by the reference numeral 100. The spark plug 100 comprises a metal main body or shell 1 which supports or surrounds an insulator 2. The insulator 2 is fitted inside or surrounded by the metal main body 1 and has a tip end section 27 which projects from the metal main body 1. A center electrode 3 is disposed inside the insulator 2 in such a manner that its ignition section or tip end section 31 projects from the insulator tip end section 27. The ignition section 31 is formed at the tip end section of the center electrode 3. A ground electrode 4 has an base end section which is connected to the metal main body 1 by means of welding or the like. The ground electrode 4 is bent generally L-shaped to have an tip end section whose side surface is opposite to the ignition section 31 of the center electrode. The ground electrode 4 has the shape of a generally rectangular parallelopiped in a condition established before it has been bent.

A tip 5 is fixed to the ground electrode 4 and located opposite to the ignition section 31 of the center electrode 3 for the purpose of improving a resistance (spark-consumption resistance) of the ground electrode 4 against consumption due to spark. Accordingly, the tip 5 serves as a spark-consumption resistant electrode material which is resistant to consumption due to spark. The tip is formed of a material (alloy) whose main component is a noble metal. The main component means a component whose content (% by weight) is the largest in all components (this is common throughout this specification). The tip 5 is fixed in such a manner that its major part is embedded in the ground electrode 4. The tip 5 projects from the ground electrode 32 to form the ignition section 32 of the ground electrode 4. Similarly, a tip 8 formed of a material (alloy) whose main component is a noble metal is fixed to the tip end section of the center electrode 3 by means of welding, caulking or the like thereby forming the ignition section 31. A spark gap g is formed between the ignition section 31 of the center electrode 3 and the ignition section 32 of the ground electrode 4.

The insulator 2 is formed of a ceramic sintered body of alumina, aluminum nitride and/or the like. The insulator 2 is formed thereinside with an axially extending hole into which the center electrode 3 is to be fitted. The metal main body 1 is formed of a metal such as a low carbon steel and/or the like and formed cylindrical, serving as a housing of the spark plug 100. The metal main body 1 is formed at its peripheral surface with threads 7 through which the spark plug 100 is installed to a cylinder head of an internal combustion engine, though not shown.

The center electrode 3 and the ground electrode 4 have respective their man body sections 3*a*, 4*a* which are formed of heat resistant Ni-based alloy or the like. The Ni-based alloy contains Ni as a main component. The ignition section 31 and the opposite ignition section 32 are formed of the alloy whose main component is Pt, Ir and/or the like. Particularly the alloy (Ir alloy) whose main component is Ir is excellent in spark-consumption resistance and therefore suitably used for the spark plug of the present invention. In this alloy, a Ir—Rh alloy containing a meaningful amount (for example, 10 to 30% by weight) of Rh is excellent both in spark-consumption resistance and oxidation and vaporizing-consumption (consumption due to vaporization) resistance. Additionally, the alloy whose main component is Ir is largely different in melting point from Ni-based alloys which are generally used as a parent (major) material of electrodes. Accordingly, the alloy whose main component is Ir is very difficult to be welded according to welding methods; however, such an alloy is very suitable for the material of the tips 5, 8.

The tips 5, 8 are formed of an alloy molten material or a sintered material which is obtained by compacting and sintering alloy powder or a mixture of metal single component powders. The alloy molten material is formed by mixing and melting alloy components. The mixture of metal single component powders are formed by mixing a plurality of metal single component powders in a certain ratio. In case of forming the tips 5, 8 of molten alloy (or the alloy molten material), the tips 5, 8 are formed by causing the alloy molten material to be subjected to at least one of rolling and forging, drawing, machining, cutting and punching, thereby obtaining the tips of desired shapes.

Figure 2:
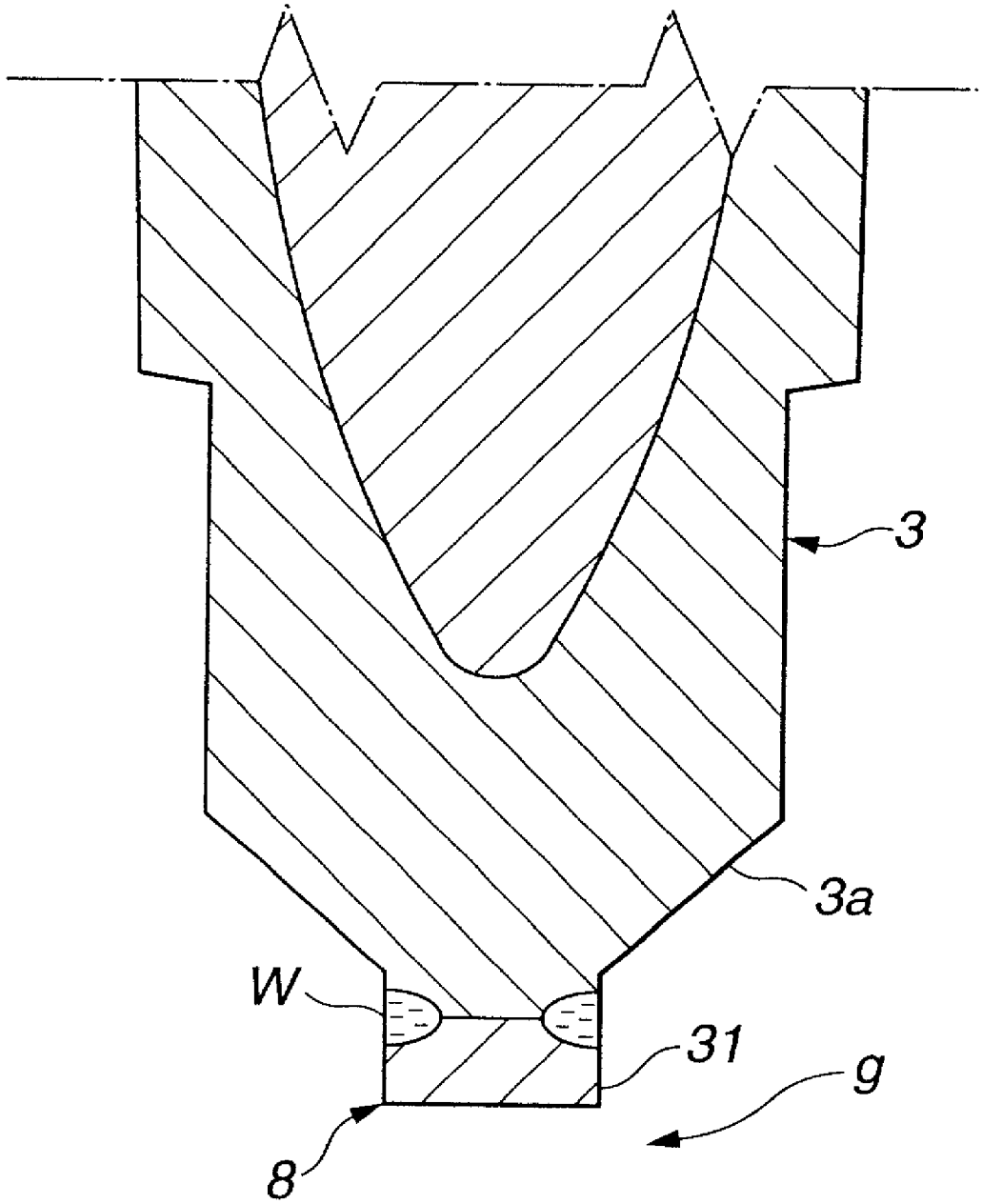
FIG. 2 is a schematic enlarged fragmentary sectional view of a center electrode of the spark plug of FIG. 1, illustrating a process and mode of fixing a tip to the center electrode.

As shown in FIG. 2, the tip 8 to be fixed to the center electrode has a generally cylindrical or column-like shape. Specifically, the tip 8 is fabricated, for example, by a method in which molten alloy is formed plate-shaped to obtain a plate-shaped material under hot rolling, and then the plate-shaped material is punched into a certain shape under hot punching, or by another method in which the molten alloy is formed linear or rod-like under hot rolling or hot forging to obtain a linear or rod-like material, and then the liner or rod-like material is cut to have a certain length thereby obtaining the tip 8. The generally column-like tip 8 is put on the tip end face of the center electrode 3 which end face has been previously flattened, forming a joining plane at which the tip end face of the center electrode 3 and the flat end face of the tip 8 are in contact with each other. Thereafter, laser welding, electron beam welding or the like is made along the outer periphery of the joining plane to form an annular molten (and solidified) section W thereby fixing the tip 8 to the center electrode 3, thus forming the ignition section 31.

Figure 3A:
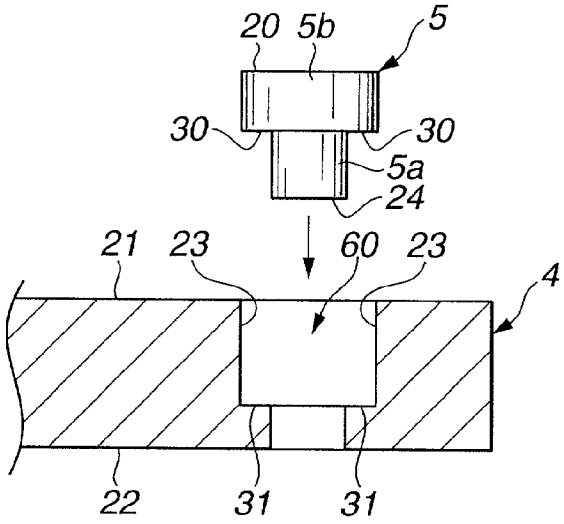
FIGS. 3A to 3D are schematic fragmentary sectional views illustrating a process and mode of fixing a tip to a ground electrode.

An example of process and mode of fixing the tip 5 to the ground electrode 4 will be discussed with reference to FIGS. 3A to 3D which respectively correspond steps of the process for joining the tip to the ground electrode. In FIG. 3A, an insertion hole 60 is formed to have an axis (not shown) which is generally aligned with the axis of the center electrode 3. The insertion hole 60 includes a large-diameter cylindrical section and a small-diameter cylindrical section which are coaxial with each other and connected with each other, forming an annular engaging surface (portion) 31 between the large-diameter cylindrical section and the small-diameter cylindrical section. The large-diameter cylindrical section is opened to a back-side surface 21 (back-side relative to the spark gap g) whereas the small-diameter cylindrical hole is opened to a front-side surface 22 (front-side relative to the spark gap g) of the ground electrode. The ground electrode 4 may be of the flat shape or the shape of a rod having a circular cross-section. In such a case, the ground electrode is imaginarily divided into two sections (located respectively on the back-side and the front-side) along a central plane which two sections respectively serve as the back-side surface 21 and the front-side surface 22.

Figure 3B:
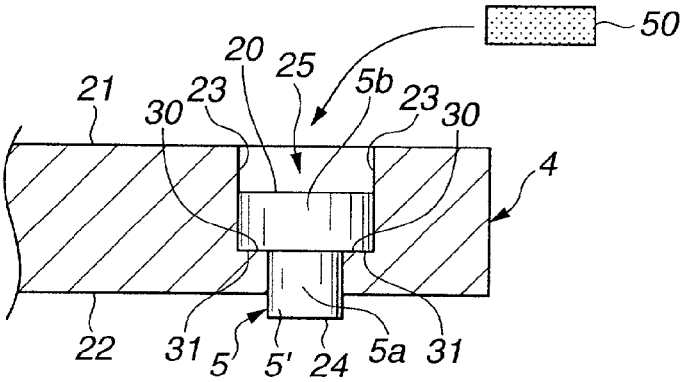

The tip 5 includes a small-diameter (cylindrical) section 5*a* and a large-diameter (cylindrical) section 5*b* which are coaxial with each other and integral with each other, forming an annular engaging surface 30 serving as a part of the surface of the large-diameter cylindrical section 5*b*. As shown in FIGS. 3A and 3B, the tip 5 is inserted into the insertion hole 60 from the back-side surface 21 of the ground electrode 4. When the tip 5 has been inserted into the insertion hole 60 of the ground electrode 4, the engaging surface 30 of the tip 5 is brought into engagement with the engaging surface 31 of the insertion hole 60 thereby preventing the tip 5 from movement toward the spark gap g. The tip 5 is fabricated similarly to the tip 8 on the side of the center electrode 3, and therefore is fabricated by a powder metallurgy method, a method of forming molten alloy into the shape of the tip 8 under hot rolling or hot forging, or a method of machining a formed body obtained by these methods into a desired shape.

In a state where the tip 5 has been inserted into the insertion hole 60 of the ground electrode 4, the tip end portion of the small-diameter cylindrical section 5*a* projects from the front-side surface 22 into the spark gap g while a cylindrical depression 25 is formed between the back-side surface 21 of the ground electrode 4 and an end face 20 (located on the backside relative to the spark gap g and therefore referred hereinafter to as "tip rear end face") of the tip 5. The cylindrical depression 25 is defined by a cylindrical inner peripheral surface (defining the insertion hole 60) of the ground electrode 4. The cylindrical depression 25 is filled with a tip (lid member) 50 formed of the heat resistant Ni-based alloy which is the same as the alloy forming the parent material of the ground electrode 21. Thereafter, arc welding is made from the back-side surface 21 of the ground electrode 4 so as to melt the tip 50 and a portion (of the ground electrode 4) around the tip 50. The tip 50 may be formed of a different material from the parent material of the ground electrode 4 as far as the different material is near in melting point and linear expansion coefficient to the parent material of the ground electrode 4. Concerning the shape of the tip 50, it is unnecessary to precisely machine the tip 50 in conformity with the shape of the depression 25 since the tip 5 is molten under the arc welding. As the arc welding, the arc welding of a so-called non-deposition type is preferably used, in which a tungsten inert gas (TIG) welding method is more preferably used to accomplish welding upon flowing inert gas such as argon gas or the like so as to isolate a welding section from air.

Figure 3C:
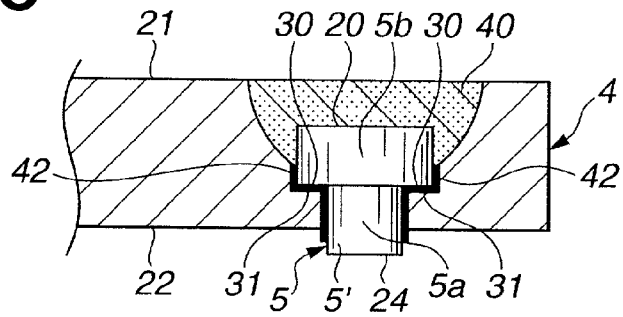

When the arc welding has been completed, a state shown in FIG. 3C is established. In this state, the tip 50 and the parent material (the heat resistant Ni-based alloy having a relatively low melting point) of the ground electrode 4 is molten under the arc welding, so that a tip rear end molten (and solidified) section 40 at or around the tip rear end face 20 is formed in tight contact with the tip 5. This molten section 40 exists between and tightly joins the tip 5 and the ground electrode 4. As a result, the tip 5 can be prevented from movement toward the back-side surface 21 of the ground electrode 4. The molten section 40 is exposed to the ground electrode back-side surface 21 in such a manner as to be in flush with the back-side surface 21. Although a slight amount of the components of the tip 5 may be mixed into the molten section 40, the molten section 40 is generally formed of the mixture of the components of the parent material of the ground electrode 4 and the components of the tip 50.

In the state shown in FIG. 3B established before carrying out the arc welding, a clearance is formed between the cylindrical outer peripheral surface of the tip 5 and the cylindrical inner peripheral surface 23 of the insertion hole 60 in accordance with a dimensional difference between the tip 5 and the insertion hole 60. When the arc welding is made, a molten metal formed of the molten parent material of the ground electrode 4 and the molten tip 50 flows into the clearance. As a result, the clearance is filled with the molten metal, forming an annular or surrounding molten (and solidified) section 42 in such a manner as to surround the tip 5. It is to be noted that this annular molten section 42 is formed integral with the above-mentioned molten section 40. This annular molten section 42 prevents the tip 5 from movement in a side-direction or direction perpendicular to the axial direction of the insertion hole 60. The cylindrical side-surface or outer peripheral surface of the portion 5' (of the tip 5) projected from the ground electrode front-side surface 22 to the spark gap g may be covered with the annular molten section 42.

The tip 5 has been sufficiently fixed to the ground electrode 4 when the state shown FIG. 3C is established. In order to further securely join the tip 5 to the ground electrode 4, a laser molten (and solidified) section 41 in which the components of the tip 5 and the ground electrode 4 are mixed is formed by laser welding. The tip 5 is formed of the alloy whose main component is Ir, and therefore it is preferable to momentarily melt the tip 5 and the ground electrode 4 by using welding methods for enlarging an energy density such as laser welding or electron beam welding in order to cause the tip 5 to melt together with the parent material of the ground electrode 4.

Figure 3D:
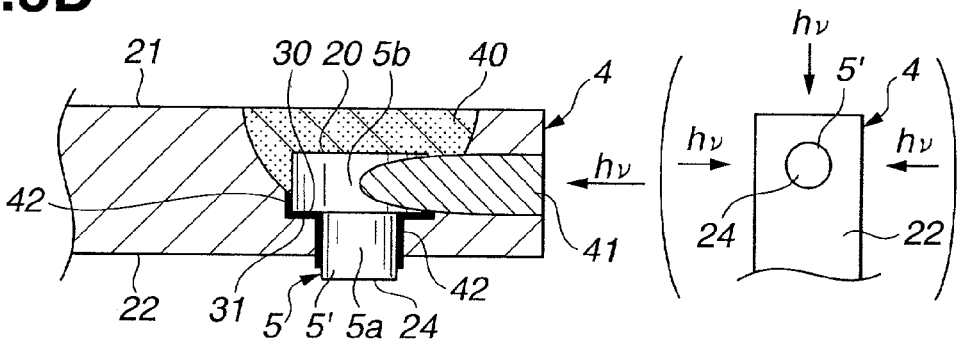

When joining of the tip 5 to the ground electrode 4 has been completed upon making the laser welding, a state shown in FIG. 3D is established. In this state, the laser molten section 41 formed by the laser welding is formed throughout both the tip 5 and the ground electrode 4. An irradiation of laser (hv) of the laser welding may be allowed in any directions as far as the laser irradiation is not made through the front-side surface 22 of the ground electrode 4. A view in parentheses in FIG. 3D shows the tip end section of the ground electrode 4 as viewed from a direction perpendicular to the front-side surface 22 of the ground electrode 4. As shown in FIG. 3D, the laser can be irradiated in directions indicated by arrows. The cylindrical side-surface of the portion 5' (of the tip 5) projected from the ground electrode front-side surface 22 to the spark gap g may be covered with the laser molten section 41.

Figure 7:
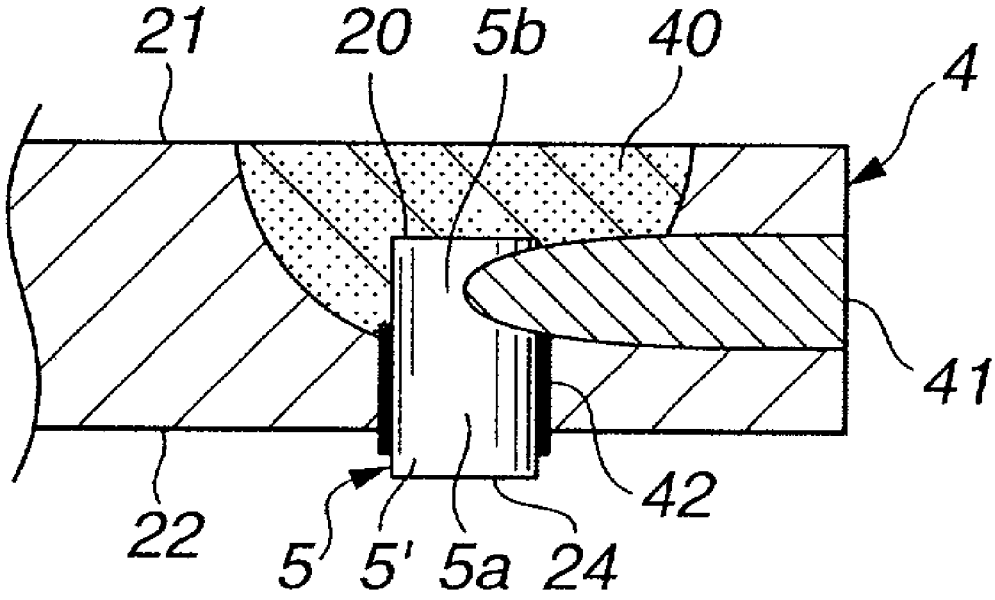
FIG. 7 is a schematic fragmentary sectional view similar to FIG. 3D but illustrating another modified mode of fixing the tip to the ground electrode.

As shown in FIG. 7, the cylindrical section 5*a* and the cylindrical section 5*b* may have the same diameter so as to form a column-like structure. In this case, the joining strength is low as compared with a case in which the diameter of the cylindrical section 5*b* is larger than that of the cylindrical section 5*a*; however, the production cost of the tip 5 itself is lowered. Additionally, by forming the laser molten section 41 similarly to the mode shown in FIG. 3D, the joining strength of the tip 5 to the ground electrode 4 can be improved.

Figure 6A:
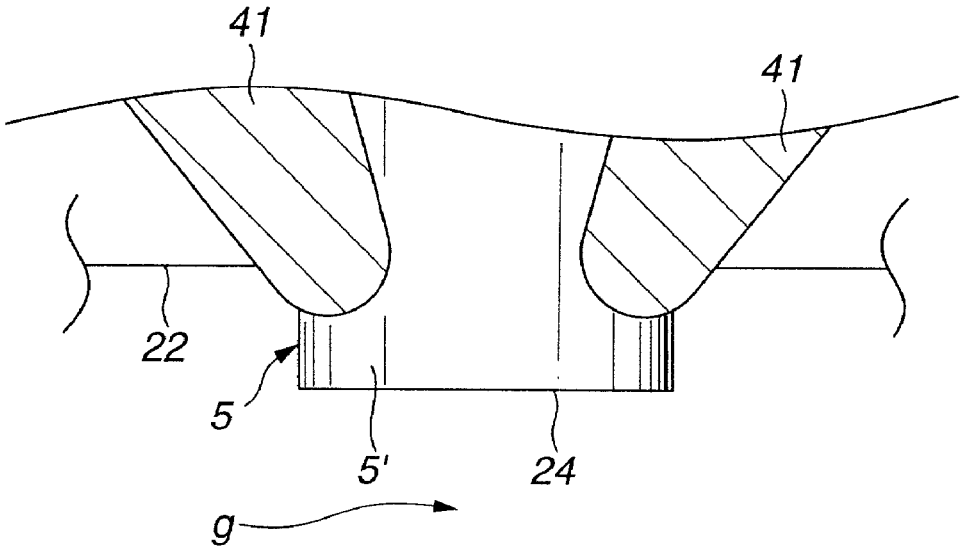
FIGS. 6A and 6B are schematic enlarged fragmentary sectional views showing examples of a portion of the spark plug projected from the ground electrode of the present invention.
Figure 6B:
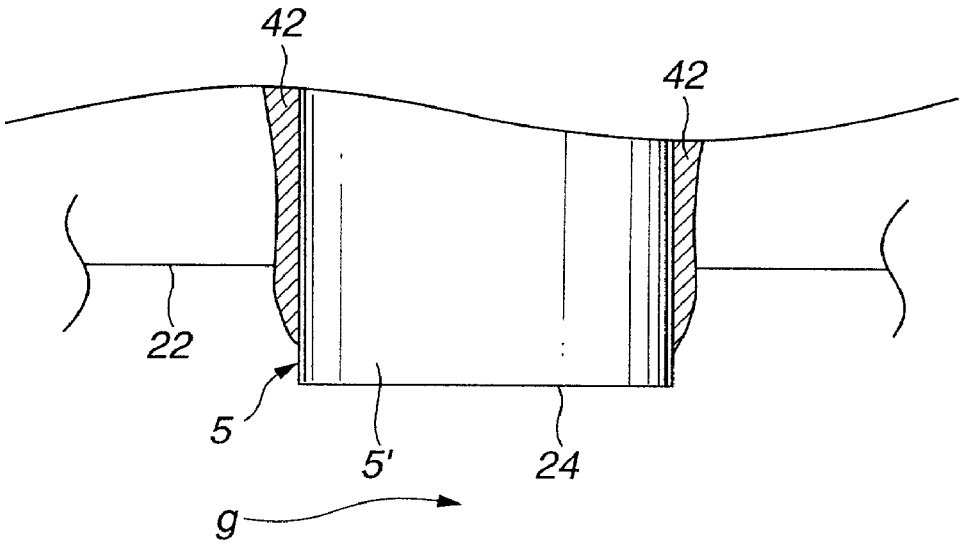

Now, in general, a Ni-based alloy tends to readily produced a spark discharge as compared with a Ir-based alloy. The annular molten section 42 is formed of the Ni-based alloy originated from the lid member 50 and the ground electrode 4, whereas the laser molten section 41 is formed of the mixture of the Ir-based alloy and the Ni-based alloy. Accordingly, in case that such a section as the laser molten section 41 is formed at a spark gap-side end face 24 of the tip 5, i.e., exposed to the front-side surface (spark discharge surface) 22 of the ground electrode 4, spark discharge will be concentrated at the section at the spark gap-side end face 24 thereby causing a selective consumption of the section to proceed. From this view point, it is not preferable that the laser molten section 41 or the previously described annular molten section 42 is exposed to the spark discharge surface 22 of the ground electrode 4. However, in case that the cylindrical side-surface of the portion 5' (of the tip 5) projected from the ground electrode front-side surface 22 to the spark gap g is covered with the laser molten section 41 or the annular molten section 42 as shown in FIGS. 6A and 6B, a thermal conduction between the tip 5 and the ground electrode 4 can be improved. Therefore, the configurations shown in FIGS. 6A and 6B are rather preferable.

While an example of the fixing manner of the tip 5 to the ground electrode 4 has been shown and described such that the laser welding is carried out after the arc welding with reference to FIGS. 3A to 3D, it will be understood that the laser welding may be carried out before the arc welding.

Although the tip 5 has been shown and described as having the small-diameter section 5*a* and the large-diameter 5*b*, it will be appreciated that the small-diameter section and the large-diameter section may be replaced respectively with a section having a small cross-sectional area and a section having a large cross-sectional area in case that the tip does not have a circular cross-section, the cross-sectional area being on a plane or cross-section perpendicular to the axis of the tip 5.

Figure 4A:
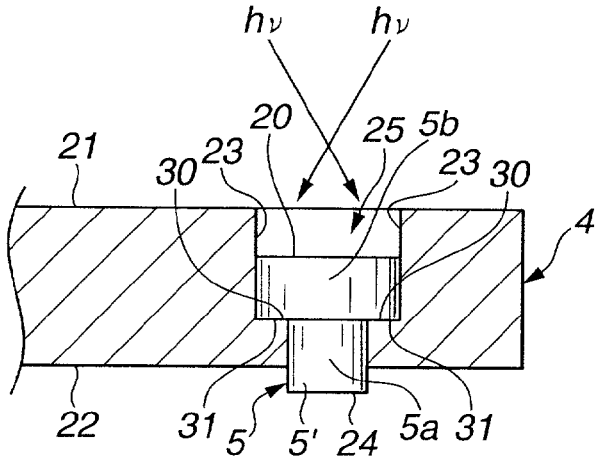
FIGS. 4A to 4C are schematic fragmentary sectional views illustrating a modified process and mode of fixing the top to the ground electrode.
Figure 4B:
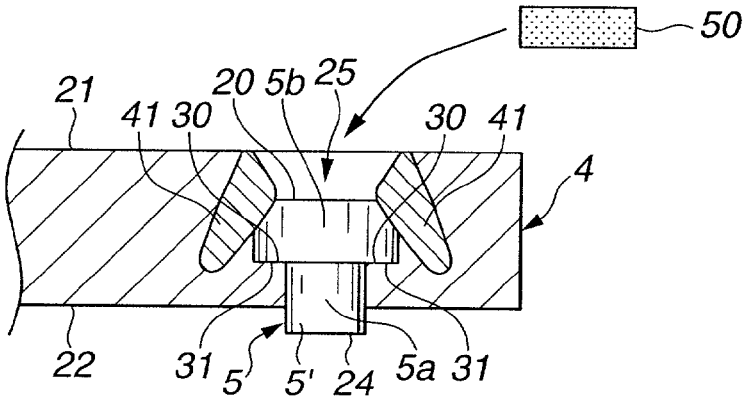
Figure 4C:
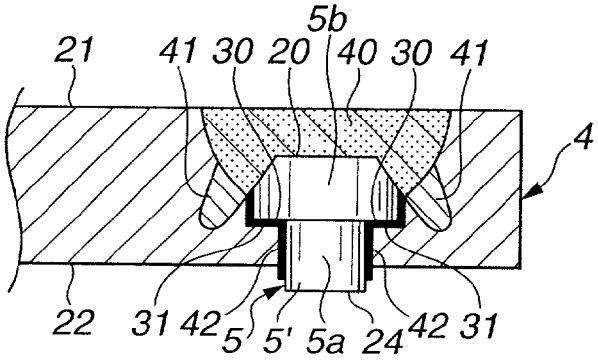
Figure 5A:
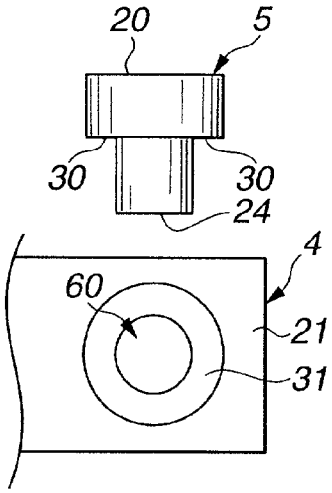
FIGS. 5A to 5F are schematic fragmentary sectional views illustrating various examples in shape of the tip and an insertion hole into which the tip is inserted, in the spark plug according to the present invention.
Figure 5B:
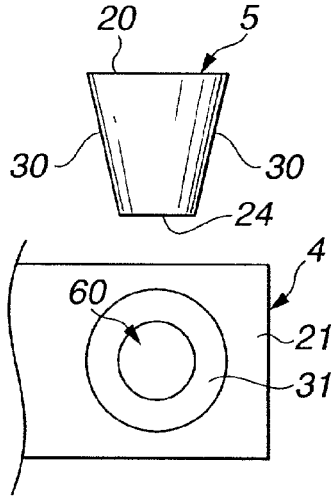
Figure 5C:
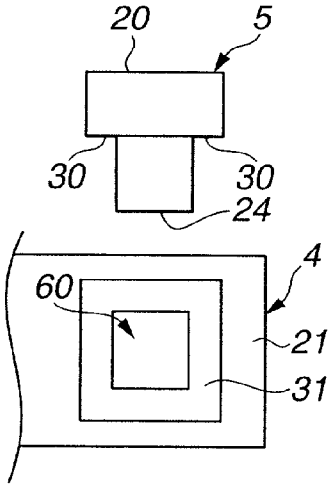
Figure 5D:
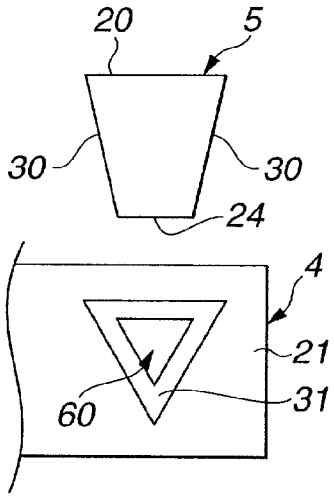
Figure 5E:
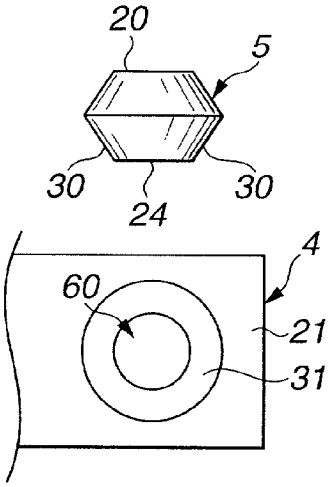
Figure 5F:
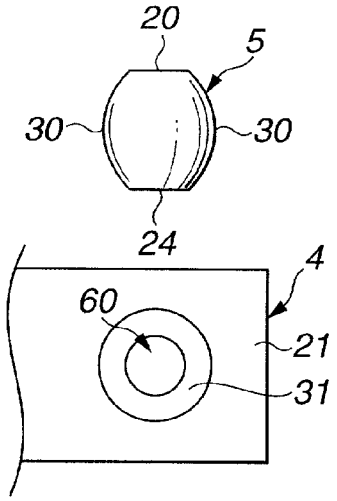

FIGS. 4A to 4C illustrate a modified example of process and mode of fixing the tip 5 to the ground electrode 4, similar to the example of FIGS. 3A to 3D. The process is the strictly same as that in FIGS. 3A to 3D in a part made until the tip 5 is inserted into the insertion hole 60. Then, after insertion of the tip 5 into the insertion hole 60, first laser welding (hv) is carried out from the side of the back-side surface 21 of the ground electrode 4 as shown in FIG. 4A, thereby forming the laser molten section 41 throughout the tip 5 and the ground electrode 4 as shown in FIG. 4B. Thereafter, the cylindrical depression 25 is filled with the tip 50 in such a manner that the tip 50 is in contact with the tip rear end face 20, followed by carrying out arc welding. Here, the laser molten section 41 does not completely surround the tip 5, and therefore the annular molten section 42 surrounding the tip 5 can be formed by carrying out the arc welding. Otherwise, the laser molten section 41 may be formed in such a manner as to completely surround the tip 5.

As appreciated from the above, the process of fixing the tip 5 to the ground electrode 4 is carried out after or before the ground electrode 4 is installed to the metal main body 1 of the spark plug 100, or after or before the ground electrode 4 is bent. Thus, welding of the tip 5 may be accomplished in the above any timings because welding is not carried out from the side of the spark gap g, so that the order of steps in a production process for the spark plug 100 cannot be singly determined.

FIGS. 5A to 5F illustrate various examples in shape of the tip 5 and the insertion hole 60. In each of FIGS. 5A to 5F, an upper figure shows a schematic side view of the tip 5 while a lower figure shows a schematic fragmentary plan view of the ground electrode 4 as viewed from the spark gap g. Of the various examples of FIGS. 5A to 5F, there are ones in which the large-diameter section and the small-diameter section of the tip 5 are not clearly separated or defined from each other; however, it may be clear that a section (of the tip 5) projected from the ground electrode 4 upon insertion of the tip 5 into the insertion hole 60 constitutes the small-diameter section, whereas a section (of the tip 5) embedded in the ground electrode 4 upon insertion of the tip 5 into the insertion hole 60 constitutes the large-diameter section. Thus, any shapes of the tip 5 and the insertion hole 60 used in combination may be employed for the spark plug 100 according to the present invention as far as they are arranged such that the tip 5 cannot fall off toward the spark gap g.

While the invention has been particularly shown and described with reference to preferred embodiments thereof, it will be understood that those skilled in the art that the foregoing and other changes in form and details can be made therein without departing from the spirit and scope of the invention.

Next, configuration and advantageous effects of the spark plug according to the present invention will be discussed.

The spark plug according to the present invention comprises the center electrode. The insulator is disposed around the center electrode. The metal main body is disposed around the insulator. The ground electrode has the first end section connected to the metal main body, and the second end section located opposite to the center electrode. The tip is formed of an alloy whose main component is Ir. The tip serves as the spark consumption-resistant electrode material. The tip has the axis directed to the center electrode. In the spark plug, the tip includes the first (large-diameter) section embedded in the ground electrode, and the second (small-diameter) section located nearer to the center electrode than the first section along the axis to form the spark gap between it and center electrode. The first section is larger in cross-sectional area than the second section to prevent the tip from movement in the first direction toward the center electrode. Additionally, in the spark plug, the molten and solidified section formed of alloy is disposed to fix the tip to the ground electrode to prevent the tip from movement at least in the second direction opposite to the first direction and in the third direction perpendicular to the first and second directions.

According to the spark plug of the present invention, the tip whose main component is Ir is embedded in the ground electrode. The tip has the small-diameter (small cross-sectional area) section whose end face is exposed from the ground electrode, and the large-diameter (large cross-sectional area) section which is embedded in the ground electrode. The tip can be prevented from its movement toward the spark gap because the large-diameter section is embedded in the ground electrode, while the tip can be prevented from its movement in the opposite direction to that of the spark gap and its lateral movement. The molten (and solidified) section is in tight contact with the tip to fix the tip to the ground electrode, or contains the components of the tip and the ground electrode. As a result, heat received by the tip during operation of the internal combustion engine can be securely transmitted to the ground electrode, thereby preventing the temperature of the tip from rising. The tip whose main component is Ir increases in its consumption under spark discharge as the temperature of the tip rises, and therefore a contribution will be made to suppressing the consumption of the tip by preventing a temperature rise in the tip. It may be assumed that the molten section is formed by welding, so that there is the possibility of the tip falling off upon making its crack under repetition of applications of low and high temperatures during use of the internal combustion engine. However, according to the present invention, the small-diameter section of the tip is exposed from the ground electrode to form the spark gap while the large-diameter section of the tip is embedded in the ground electrode. As a result, the tip can be prevented from falling off at least toward the spark gap. On the assumption that that the tip falls off toward the spark gap, the tip will come into contact with the center electrode to form a short circuit between the ground electrode and the center electrode, thus preventing spark discharge from generation. If no spark discharge is generated, normal operation of the internal combustion engine will be prevented. It will be understood that occurrence of such undesirable situation can be securely prevented by using the spark plug according to the present invention.

The spark plug production method according to the present invention is for the spark plug including the center electrode, the insulator disposed around the center electrode, and the metal main body disposed around the insulator. The method comprises the steps of: (a) preparing the ground electrode having the first end section connected to the metal main body, and the second end section located opposite to the center electrode, the ground electrode having the first (front-side) surface facing the spark gap, and the second (back-side) surface opposite to the first surface, the ground electrode having the portion defining the insertion hole extending from the first surface to the second surface, the insertion hole defining portion including the engaging portion; (b) preparing the tip serving as the spark consumption-resistant electrode material, the tip including a first section, and the second section smaller in cross-sectional area than the first section; (c) inserting the tip into the insertion hole in a manner that the first section of the tip is brought into engagement with the engaging portion of the ground electrode and that the tip is located below the second surface of the ground electrode to form the depression; (d) inserting the lid member in the depression; and (e) welding the lid member and the ground electrode in a manner that whole of lid member melts and that the molten material originated from at least the lid member fills the clearance formed between the tip and the surface of the insertion hole.

According to the spark plug production method of the present invention, the tip formed of the noble metal is inserted into the insertion hole formed in the ground electrode thereby fixing the tip in position. The insertion hole is formed such that the tip and the center electrode are opposite to or face each other thereby to form the spark gap. After the tip is inserted from the back-side surface (relative to the spark gap) of the ground electrode into the insertion hole, welding is made on the ground electrode and the lid member. By this, the tip can be prevented from movement toward the opposite side with respect to the spark gap. The tip has the large-diameter section, while the insertion hole is provided with the engaging portion with which the large-diameter section is brought into engagement. As a result, the tip is prevented from falling off toward the spark gap. It is sufficient that the insertion hole has such a shape that its diameter decreases in a direction toward the spark gap. The shape of the insertion hole may be a tapered shape wherein the diameter continuously decreases, or a step-like shape wherein the large-diameter and small-diameter sections are contiguous with each other. It will be understood that the tip may be produced to have a shape corresponding to the shape of the insertion hole.

The molten section for fixing the ground electrode and the tip is preferably formed by arc welding and/or laser welding. It is difficult to momentarily weld materials having largely different melting points by using arc welding; however, it is possible to first melt the material having the low melting point so as to wrap the material having the high melting point, thereby fixing the both materials with each other. By this, the molten section and the tip come into tight contact with each other, and therefore heat received by the tip can be securely transmitted to the ground electrode, thereby minimizing the temperature difference between the tip and a portion of the ground electrode around the tip. The tip increases in its consumption under spark discharge as the temperature of the tip rises, and therefore a contribution will be made to suppressing the consumption of the tip by preventing a temperature rise in the tip.

In the present invention, the material having the low melting point corresponds, for example, to the heat resistant Ni-based alloy which is extensively and commonly use. The material having the high melting point corresponds to the Ir alloy of the tip. If arc discharge is continued until the tip melts, the shape of the ground electrode cannot be maintained. Accordingly, it is preferable that the arc welding is stopped at a suitable timing at which the tip has not yet been molten. Otherwise, laser welding makes it possible to melt and join the materials having different melting points for a very short welding time by controlling the pulse and energy density of laser. Thus, by using the above welding methods, the above-mentioned molten section can be formed to prevent the tip from falling off toward the opposite side with respect to the spark gap.

Additionally, the tip has the end face (tip rear end face) opposite to the end face facing the spark gap. The tip rear end face is located nearer to the front-side surface (facing the spark gap) of the ground electrode than the back-side surface of the ground electrode, and is covered with the molten section, thereby fixing the tip to the ground electrode.

In general, the Ir alloy is expensive, and therefore it is preferable that the part of the tip embedded in the ground electrode is formed as small as possible. By locating the tip rear end face nearer to the front-side surface (facing the spark gap) of the ground electrode than the back-side surface of the ground electrode, the depression is formed by the tip rear end face and the inner peripheral surface of the insertion hole. A meaningful amount (volume) of the lid member formed of the material which is the same or generally the same as the parent material of the ground electrode is put in the depression, followed by welding the lid member to the ground electrode, for example, by using arc welding. In case that the lid member is formed of the same material as the parent material of the ground electrode, thermal stress is hardly generated at the molten section even under heat cycle, thereby securely fixing the tip to the ground electrode. By employing the arc welding, the member to be welded into the depression is molten by arc so as to join the tip to the ground electrode without leaving its original shape, and therefore no attention is necessary to be paid on the shape of the tip as compared with a case where joining between the tip and the ground electrode is made by using resistance welding. In other words, machining cost of the constituting members of the spark plug can be reduced. Extremely speaking, a molded body which is formed by collecting and suitably molding chips produced during formation of the insertion hole may be used as the tip.

In addition to the molten section (located at the tip rear end face), a surrounding molten (and solidified) section is preferably formed in a manner to surround the peripheral surface of the tip at a part embedded in the ground electrode. By this, heat of the tip can be more effectively transmitted to the ground electrode. For example, it is easy to form a clearance of about 0.1 mm between the outer periphery of the tip and the inner periphery of the insertion hole; however, the clearance has yet existed between the tip and the surface of the insertion hole owing to the difference in dimension between the tip and the insertion hole. This clearance is filled with the above surrounding molten section, so that thermal conduction and joining strength between the tip and the ground electrode are further improved. In this case, it is unnecessary that the peripheral surface of the tip and the peripheral surface of the insertion hole are in precisely tight contact with each other, and therefore an extremely high dimensional precision is not required to produce the tip and to form the insertion hole, thereby lowering machining cost for production of the spark plug.

It is preferable that welding of the tip and the ground electrode is carried out by using two kinds of welding methods, in which arc welding and laser welding are used in combination. By carrying out the laser welding, both the tip and the ground electrode can be momentarily molten to form the molten section in which the components of them are mixed with each other. By carrying out the arc welding, it is difficult to form the molten section in which the components are mixed; however, it is possible to selectively melt only a material part having a lower melting point throughout a wide region, thereby to form the molten section in a manner to wrap the tip. It will be understood that the molten section formed under the above different methods totally functions to further rigidly fix the tip to the ground electrode.

Further, it is preferable that the tip is fixed to the ground electrode in such a manner that the end face of the small-diameter section of the tip projects toward the spark gap in order to securely produce spark between the center electrode and the oppositely located tip. However, the ground electrode tends to become very high in temperature as compared with the center electrode. In case that the tip projects from the ground electrode, heat received by the tip becomes much while heat radiation from the ground electrode become small, so that the ground electrode tends to further become high in temperature. Particularly in case that the tip is formed of a material whose main component is Ir, consumption of the tip under spark discharge increases as the temperature of the tip rises, and therefore a contribution will be made to suppressing the consumption of the tip by preventing a temperature rise in the tip. According to the present invention, the side peripheral surface of the projected portion of the small-diameter section of the tip projected toward the spark gap may be covered with the molten section, which will prevent the tip (tends to become high in temperature) from receiving heat and promote heat radiation from the side peripheral surface of the projected portion.

What is claimed is:

1. A spark plug comprising:

a center electrode;

an insulator disposed around said center electrode;

an metal main body disposed around said insulator;

a ground electrode having a first end section connected to said metal main body, a second end section located opposite to said center electrode, and an insertion hole having a first portion and a second portion, the first portion of said insertion hole being larger in cross-sectional area than the second portion of said insertion hole; and a tip formed of an alloy whose main component is Ir, said tip being secured to said ground electrode and serving as a spark consumption-resistant electrode material, said tip having an axis directed to said center electrode, said tip including a first section located in the first portion of said insertion hole, and a second section located nearer to said center electrode than the first section along the axis to form a spark gap between it and said center electrode and partially located in the second portion of said insertion hole, the first section of said tip being larger in cross-sectional area than the second section and also than the second portion of said insertion hole, wherein a molten and solidified section formed of alloy is disposed to fix said tip to said ground electrode, said molten and solidified section including a surrounding molten and solidified section located in and filling a clerance between a peripheral surface of the tip and the first and second portions of the insertion hole.

2. A spark plug as claimed in claim 1, wherein said molten and solidified section is formed by at least one of arc welding and laser welding.

3. A spark plug as claimed in claim 1, wherien said ground electrode has a first surface facing the spark gap, and a second surface opposite to the first surface, wherien said tip has a rear end face which is opposite to a spark gap-side end face facing the spark gap, the rear end face being located nearer to the first surface of said ground electrode than the second surface of said ground electrode, wherein said molten and solidified section incdues a tip rear end molten and solidified section which covers the rear end face of said tip and is exposed to the second surface of said ground electorde.

4. A spark plug as claimed in claim 3, wherein said tip incldues a projected section integral with the second section and having an end face projected from the first surface of said ground elelctrode to the spark gap, said projected section having a peripheral surace which is covered with said molten and solidified section.

5. A spark plug as claimed in claim 1, wherein said molten and solidified section is formed by carrying out laser welding throughout said ground elelctrode and said tip, in which irradaition of laser is made through said ground elelctrode and said tip from a direction other than a surface of said ground electrode which surface faces the spark gap.

6. A spark plug as claimed in claim 5, wherein said molten and solidified section includes Ir and Ni.

7. The spark plug as claimed in claim 1, wherein said molten and solidified section further comprises material from said tip and said ground electrode.

8. The spark plug as claimed in claim 1, further comprising a second molten and solidified section.

9. The spark plug as claimed in claim 8, wherein said second molten and solidified section comprises material from said tip and said ground electrode.

10. The spark plug as claimed in claim 8, further comprising a tip-rear-end molten and solidified section.

11. A spark plug as claimed in claim 1, wherein said molten and solidified section includes Ni alloy.

12. A spark plug as claimed in claim 1, wherein said molten and solidified section includes a component of the ground electrode.

13. A spark plug as claimed in claim 1, wherein said molten and solidified section includes a laser welding section extending from a surface of said ground electrode which surface does not face the spark gap.

14. A spark plug comprising:

a center electrode;

an insulator disposed around said center electrode;

an metal main body disposed around said insulator;

a ground electrode having a first end section connected to said metal main body, a second end section located opposite to said center electrode, and an insertion hole having a first portion and a second portion, the first portion of said insertion hole being larger in cross-sectional area than the second portion of said insertion hole; and a tip formed of an alloy whose main component is Ir, said tip being secured to said ground electrode and serving as a spark consumption-resistant electrode material, said tip having an axis directed to said center electrode, said tip including a first section located in the first portion of said insertion hole, and a second section located nearer to said center electrode than the first section along the axis to form a spark gap between said tip and said center electrode and partially located in the second portion of said insertion hole;

wherein a molten and solidified section formed of alloy is disposed to fix said tip to said ground electrode, said molten and solidified section including a surrounding molten and solidified section located in and filling a clearance between a peripheral surface of the tip and the first and second portions of the insertion hole, and a laser welding section extending from a surface of said ground electrode which surface does not face the spark gap.

15. A method of producing a spark plug including a center electrode, an insulator disposed around the center electrode, and a metal main body disposed around the insulator, a ground electrode having a first end section connected to said metal main body, and a second end section located opposite to said center electrode, and an insertion hole having a first portion and a second portion, the first portion of said insertion hole being larger in cross-sectional area than the second portion of said insertion hole, and a tip formed of an alloy whose main component is Ir, said tip being secured to said ground electrode and serving as a spark consumption-resistant electrode material, said tip having an axis directed to said center electrode, said tip including a first section located in the first portion of said insertion hole, and a second section located nearer to said center electrode than the first section along the axis to form a spark gap between it and said center electrode and partially located in the second portion of said insertion hole, the first section of said tip being larger in cross-sectional area than the second section and also than the second portion of said insertion hole, wherein a molten and solidified section formed of alloy is disposed to fix said tip to said ground electrode, said molten and solidified section including a surrounding molten and solidified section located in and filling a clearance between a peripheral surface of the tip and the first and second portions of the insertion hole, the method comprising the steps of:

preparing a ground electrode having a first end section connected to the metal main body, and a second end section located opposite to the center electrode, the ground electrode having a first surface facing the spark gap, and a second surface opposite to the first surface, the ground electrode having a portion defining an insertion hole extending from the first surface to the second surface, the insertion hole defining portion including an engaging portion;

preparing a tip serving as a spark consumption-resistant electrode material, the tip including a first section, and a second section smaller in cross-sectional area than the first section;

inserting the tip into the insertion hole in a manner that the first section of the tip is brought into engagement with the engaging portion of the ground electrode and that the tip is located below the second surface of the ground electrode to form a depression;

inserting a lid member in the depression; and welding the lid member and the ground electrode in a manner that whole of the lid member melts and that a molten material originated from at least the lid member fills a clearance formed between the tip and a surface of the first and second portions of the insertion hole.

* * * * *